United States Patent [19]

Warren et al.

[11] Patent Number: 4,881,605

[45] Date of Patent: Nov. 21, 1989

[54] STABILIZING AND DRILLING APPARATUS AND METHOD

[75] Inventors: Tommy M. Warren, Coweta; Warren J. Winters; James F. Brett, both of Tulsa, all of Okla.

[73] Assignee: Amoco Corporation, Chicago, Ill.

[21] Appl. No.: 244,767

[22] Filed: Sep. 15, 1988

[51] Int. Cl.[4] ..... E21B 17/16

[52] U.S. Cl. ..... 175/320

[58] Field of Search ..... 175/57, 257, 309, 320, 175/327

[56] References Cited

U.S. PATENT DOCUMENTS 3,047,313 7/1962 Bruce ..... 175/320

3,167,137 1/1965 Humphrey ..... 175/320

4,310,059 1/1982 Moore ..... 175/320

*Primary Examiner*—Thuy M. Bui

*Attorney, Agent, or Firm*—Scott H. Brown; Fred E. Hook

[57] ABSTRACT

To stabilize a drill string and to reduce or prevent wellbore deviation in directional drilling, weight rods by which weight is to be applied to drill bit are maintained free-standing and under compression within a drill string while the drill string itself is maintained in tension to limit or prevent lateral deviation of the weight rods in compression. Weight provided by the weight rods is transferred to the drill bit through a load transfer member in compression connected between the drill string and the drill bit.

4 Claims, 5 Drawing Sheets

STABILIZING AND DRILLING APPARATUS AND METHOD

BACKGROUND OF THE INVENTION

1. Field of the Invention

This invention relates to apparatus and methods for stabilizing hole boring equipment, and more particularly, but not by way of limitation, to apparatus and methods for drilling by applying weight on a drill bit while maintaining tension in a drill string so that the drill string is stabilized and wellbore deviation is reduced.

2. Setting of the Invention

Conventional or traditional petroleum drilling methods use hole-boring equipment which includes a string of drill pipe at the bottom of which a string of drill collars is connected and at the bottom of which string of drill collars a drill bit is connected. The drill bit diameter is often at least twice the diameter of the drill pipe.

Weight is applied to the drill bit for urging it against the material to be drilled by slacking off on the drill string to place at least part of the string of drill collars in compression. With weight applied to the bit, the drill string is rotated at a speed which rarely exceeds 150 revolutions per minute and more often is less than 100 revolutions per minute.

The string of drill collars, which hangs below the string of drill pipe, can be whatever length is needed to provide sufficient weight capability for the drill bit; however, it is not uncommon for such string of drill collars to be several hundred feet long. Such a length of drill collars in compression is susceptible to lateral deviation which can cause drill string failure or borehole deviation.

Another shortcoming with conventional drill collars is that they typically have a smaller inner diameter (and a larger outer diameter) than the drill pipe to which they are connected. This smaller inner diameter can cause pressure increases in drilling fluid pumped downhole through the drill string.

Another drilling technique of more recent vintage, at least in its application to the drilling of oil or gas wells, utilizes a drill bit which has a diameter barely larger than the diameter of the drill pipe to which the bit is connected. Weight is applied to this bit by placing a significant portion of the drill string in compression. The entire drill string is rotated at high speeds (e.g., 700–1000 revolutions per minute) compared to the more conventional or traditional petroleum drilling methods. This technique is used for coring and has been used in mining-style "slim-hole" coring techniques.

This latter, relatively high-speed drilling technique has been found to have a particularly significant shortcoming in its application in the petroleum industry where drilling frequently occurs in sedimentary rocks which are not inherently sturdy enough to support the substantial length of the drill string which is in compression and which thus tends to exhibit "whipping" (i.e., cyclical lateral deformation leading to fatigue failures) within the borehole. For the borehole to prevent such "whipping", it would need to remain substantially in-gauge throughout its entire length. This is feasible in the typical mining environment having relatively hard igneous and metamorphic rocks. This is not as readily feasible, however, in the aforementioned petroleum environment which largely includes relatively soft sedimentary rocks, many of which are fluid-sensitive and mechanically unstable. The drill string failures which have been noted in the petroleum industry applications of the aforementioned high-speed drilling technique have been linked to substantial borehole enlargement whereby the stabilizing influence of an in-gauge hole on the rotating drill pipe has been lost.

It has been observed that if a nearly-gauge borehole is maintained, such as through the use of shale-stabilizing drilling fluid, failures of drill strings rotated at speeds upward of 700 revolutions per minute can be prevented or reduced, at least where the drill string is made of new, thick-walled drill pipe. Thus, it appears that the combination of borehole gauge maintenance by carefully formulated fluid and of stiffer drill pipe provides an effective "first line of defense" against drill string failures in high-speed drilling operations.

Another way to implement this "first line of defense" is by "nesting" wherein a tubular member lines the borehole to in effect produce an in-gauge wall which supports the drill string. Nesting is used as a casing technique where one size of drill pipe (also known as drill rod) is used to line the borehole, and a smaller size of drill bit and drill rod is passed through the bore and out the bottom of the larger stationary drill rod. Drilling is then resumed with the smaller equipment. Nesting is also used in the event that the larger drill rod becomes irretrievably stuck. Nesting can be employed in a given hole only once or twice before the clearances become so small as to make further drilling infeasible. It has been observed that nesting can reduce drill string vibration and failure and can allow greater rates of penetration.

Although the "first line of defense" may be suitable in some applications, it may become inadequate as the drilling progresses to greater depths. It is possible at increased depths that (1) the drill pipe size must be reduced (thus reducing strength and precluding nesting) because the hole size is reduced for the same reasons that hole sizes become progressively smaller with depth in conventional oilfield operations, and (2) borehole enlargement will occur, such as simply by accruing with time, or from breakdown of the shale-stabilizing influence of the drilling fluid, or the occurrence of cavernous zones, or mechanical borehole erosion, etc. Thus, as the borehole gets deeper, the drill pipe would become unstable whereupon failures could again occur.

Therefore, there is the need for some type of apparatus and method by which a drill string can be stabilized even where support from a borehole is lost. There is also the need for an apparatus and a method of drilling which incorporates such stabilization. That is, there is the need for a "second line of defense" which achieves the beneficial effects of the "first line of defense" (e.g., reduced drill string vibration and failure and increased rates of penetration, and thus improved reliability and performance of the drilling operation), but even in situations where the "first line of defense" may not be practicable.

Such apparatus and method should be applicable to both conventional, relatively low-speed drilling techniques and the coring, relatively high-speed techniques referred to hereinabove.

With respect to the conventional technique wherein smaller inner diameter drill collars are used, it would also be desirable if such apparatus and method could replace such drill collars with a larger inner-diameter structure.

It would also be desirable to provide a stabilizing apparatus and method or drilling apparatus and method which would at least reduce, if not altogether prevent, deviation from a straight drilling path. Although directional drilling receives considerable attention, the majority of oil wells are classified as "straight" holes, i.e., boreholes with a bottom hole target that is essentially beneath the surface location. Deviation control techniques are often utilized to assure that the borehole trajectory does not depart significantly from a vertical attitude. Also, many directional well plans call for significant segments of the well path to be drilled nearly vertically within just a few degrees of tolerance. Again, deviation control methods are often required to meet the objectives of the plan.

Deviation control is not a major problem in areas where the subsurface rocks are relatively uniform and the bedding planes are essentially horizontal. In such cases the drill bit and drill collars are influenced primarily by gravitational forces to advance vertically. In areas where the subsurface rock layers are tilted, as is frequently the case, there is a natural tendency for the drill bit and the drill collars to advance along a non-vertical path that is either perpendicular or parallel to the bedding planes. Deviation can also be caused by the lateral movement of the drill string occurring during "whipping" when a portion of the drill string is in compression. To counteract downhole deviation forces by applying a restorative force to the drill bit which influences the bit to drill vertically, a bottom hole drilling assembly is provided. This has been achieved through the use of "pendulum" assemblies.

The design of a pendulum assembly is based on mechanical principles which dictate that relatively low weight-on-bit levels be applied to the drill bit in order for the assembly to work. The rate of penetration of a drill bit is strongly influenced by the applied weight-on-bit; therefore, there is a considerable trade-off between how fast the drilling progresses (which affects the drilling costs) and deviation control (which affects whether the target is hit). Thus, this existing deviation control technique either provides insufficient inclination control (to obtain faster drilling, for example) or produces costly reductions in the rate of penetration (so that the target will more likely be hit, for example). Furthermore, where such technique of deviation control is used to counteract deviation resulting from lateral movement of a section of the drill string under compression, such technique merely resists the deviation problem rather than treating it at the source. Therefore, there is the further need for a stabilizing apparatus and method and drilling method and apparatus directed to curing this source of deviation, thereby permitting the application of full weight-on-bit levels and corresponding rates of penetration while obtaining desired deviation control.

SUMMARY OF THE INVENTION

The present invention is contemplated to overcome the foregoing deficiencies and meet the above-described needs. For accomplishing this, the present invention provides a novel and improved stabilizing apparatus and method and a novel and improved drilling apparatus and method.

A stabilizer apparatus is provided for a drill string to which a drill bit is connected. The stabilizer apparatus comprises weight means for exerting weight on the drill bit connected to the drill string. The stabilizer apparatus also comprises confining means, connected with the drill string, for confining the weight means against lateral displacement in response to tension in the confining means.

The present invention provides a drilling apparatus which comprises a drill bit, support means for carrying the drill bit, and weight means for providing a weight for loading on the drill bit, which weight means is separate from, but carried within the support means.

The present invention provides a method of stabilizing a rotating drill string and drill bit. This method comprises exerting weight on the drill bit with a mass separate from the drill string, and confining the mass against substantial lateral deviation within at least one member retained under tension.

The present invention also provides a method of drilling, comprising: rotating a drill string and drill bit assembly; carrying a mass inside the drill string, which mass is separate from the drill string; and transferring a weight exerted by the mass to the drill bit.

It is contemplated that the present invention is useful in all types of drilling where weight needs to be applied to a bit and stability within the downhole drilling equipment is desired. Two specific industries where such needs exist are the petroleum drilling industry and the mining drilling industry. It is contemplated that the present invention is particularly useful for reducing or eliminating drill string failures in mining-style "slim-hole" coring techniques, especially ones applied to sedimentary rocks of petroleum-related environments. It is also contemplated to be particularly useful for substantially reducing the source of deviation in borehole drilling, thereby allowing drilling to proceed at a greater rate of penetration with improved control of the borehole inclination.

DETAILED DESCRIPTION OF PREFERRED EMBODIMENTS

The present invention provides a drilling apparatus and a stabilizer apparatus. The drilling apparatus comprises a drill bit and support means for carrying the drill bit. It also comprises weight means for providing a weight for loading on the drill bit, which weight means is separate from, but carried within, the support means. The stabilizer apparatus comprises the weight means and confining means for confining the weight means against lateral displacement in response to tension in the confining means. Within the drilling apparatus of the preferred embodiments, the confining means is part of the support means. In the preferred embodiments the support means includes a drill string and a load transfer means for transferring the weight load provided by the weight means to the drill bit which is connected to the load transfer means.

The present invention also provides a method of stabilizing a rotating drill string and drill bit and a method of drilling. The method of stabilizing comprises exerting weight on the drill bit with a mass separate from the drill string, and confining the mass against substantial lateral deviation within at least one member retained under tension. The method of drilling comprises rotating a drill string and drill bit assembly, carrying a mass inside the drill string, which mass is separate from the drill string, and transferring a weight exerted by the mass to the drill bit.

Figure 1:
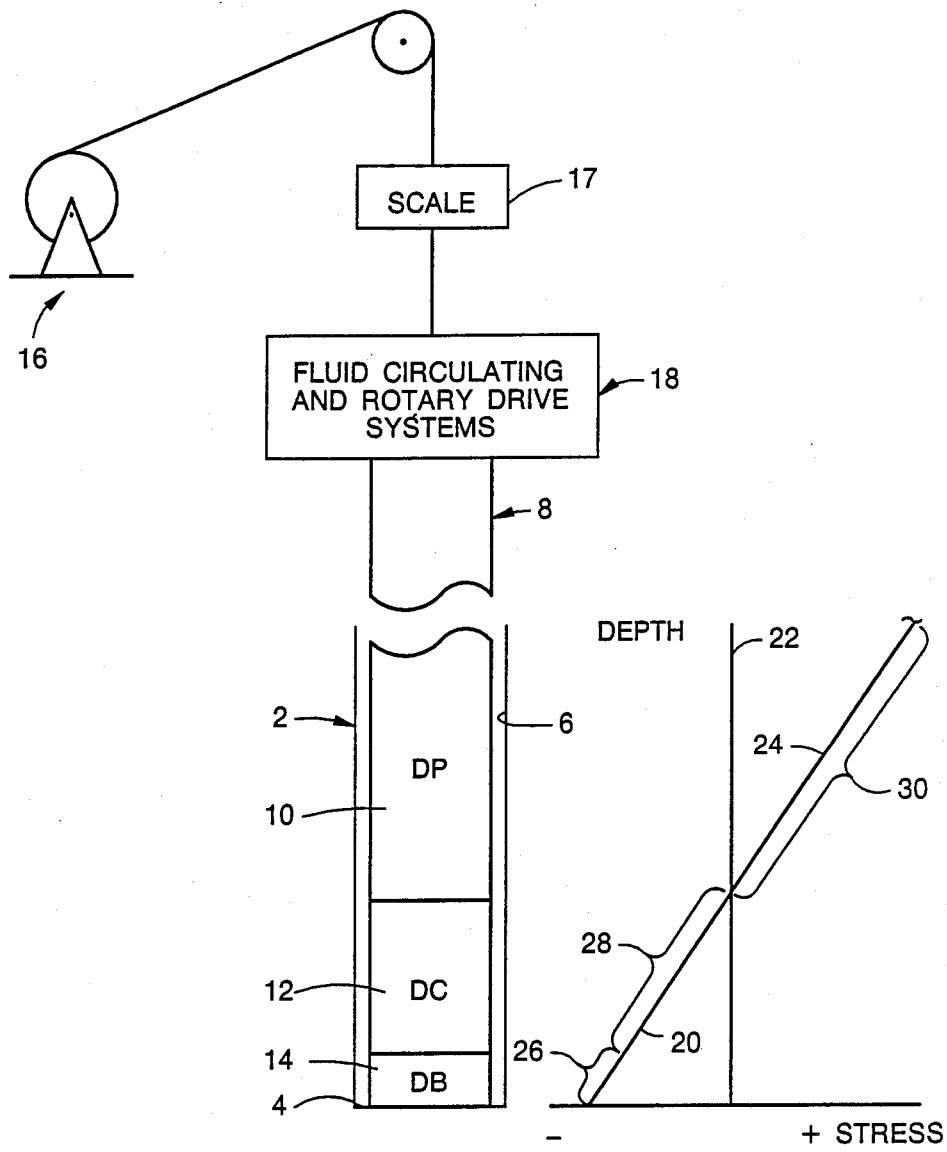
FIG. 1 PRIOR ART
FIG. 1 schematic illustration of a conventional prior art drilling assembly including a drill string, a portion of which is shown in association with a stress diagram.

Referring now to FIG. 1, a conventional prior art drilling assembly and the distribution of compressive stress (compression) and tensile stress (tension) in a portion of the assembly will be described. The drilling assembly includes downhole equipment which excavates the material to form a borehole or wellbore 2 having a bottom surface 4 and a side surface 6. The downhole equipment illustrated in FIG. 1 includes a drill string 8 comprising a string of drill pipe (DP) 10 below which a connected string of drill collars (DC) 12 extends. The downhole equipment also includes a drill bit (DB) 14 connected at the bottom or lower end of the string of drill collars 12.

The drill string 8 extends upwardly through the mouth of the borehole 2 into operative association with surface equipment. The surface equipment includes hoist means 16 for lowering and raising the drill string 8. Through the hoist means 16, tension and compression and loading of weight onto the drill bit 14 are controlled in a known manner, such as through the use of a scale 17 interconnected with the drill string 8 in known fashion. The surface equipment also includes fluid circulating and rotary drive systems 18 for rotating, and circulating fluid through, the drill string 8 and the connected drill bit 14. The rotary drive source could be a power swivel or any of various known hydraulic drive units.

The above-described downhole equipment and surface equipment are conventional and well known in the oil and gas well drilling industry.

In drilling the borehole 2, the hoist means 16 is used to lower the drill string 8 downwardly to rest the drill bit 14 on the bottom 4 of the borehole 2 until a suitable loading of weight on the drill bit 14 is obtained by some or all of the string of drill collars 12 being thereby placed in compression. Slacking off on the holding force applied by the hoist means 16 can be continued to place at least some of the string of drill pipe 10 in compression, thereby adding the weight of the drill pipe in compression onto the drill bit 14. In other schemes of downhole equipment and drilling, the string of drill collars 12 can be deleted whereby weight would be exerted on the bit solely by the portion of the string of drill pipe 10 which is in compression. In either event (i.e., either with or without drill collars), a significant portion of the overall drill string must be in compression to put sufficient weight on the drill bit. Because such portion is typically long (e.g., several hundred feet), it is subject to lateral movement ("whipping") within the borehole 2, which movement can cause drill string failure or borehole deviation.

In further describing what is illustrated by FIG. 1, it will be assumed that the drill bit 14 and the entire string of drill collars 12 are in compression with the remainder of the drill string above the drill collars (i.e., the string of drill pipe 10) in tension. A graph line 20 to the left of vertical "depth" line 22 in the stress diagram of FIG. 1 depicts the compression, and graph line 24 to the right of the vertical line 22 represents the tension (the slopes of the stress-representing lines 20, 24 are shown to be the same, but the slopes could be different for each portion of the downhole equipment depending upon the effective cross-sectional areas thereof; however, this is not material to the explanation of the prior art or the present invention and thus different slopes are omitted for clarity and convenience).

The drill bit 14 being under compression is indicated by segment 26 of the graph line 20; the string of drill collars being under compression is indicated by segment 28 of the graph line 20; the remainder of the drill string being under tension is indicated in part by segment 30 of the graph line 24. The entire graph comprising the compression-indicating graph line 20 and the tension-indicating graph line 24 depict a continuum up the length of the drill bit 14 and the drill string 8 from maximum compression at the bottom to maximum tension at the top. The portion of the downhole equipment indicated to be in compression can be a substantial length (e.g., several hundred feet) so that even though the components of such length are individually rigid, they are flexible in their overall length and thus subject, under compression, to lateral deviation confined only by the side surface 6 of the borehole 2.

Figure 2:
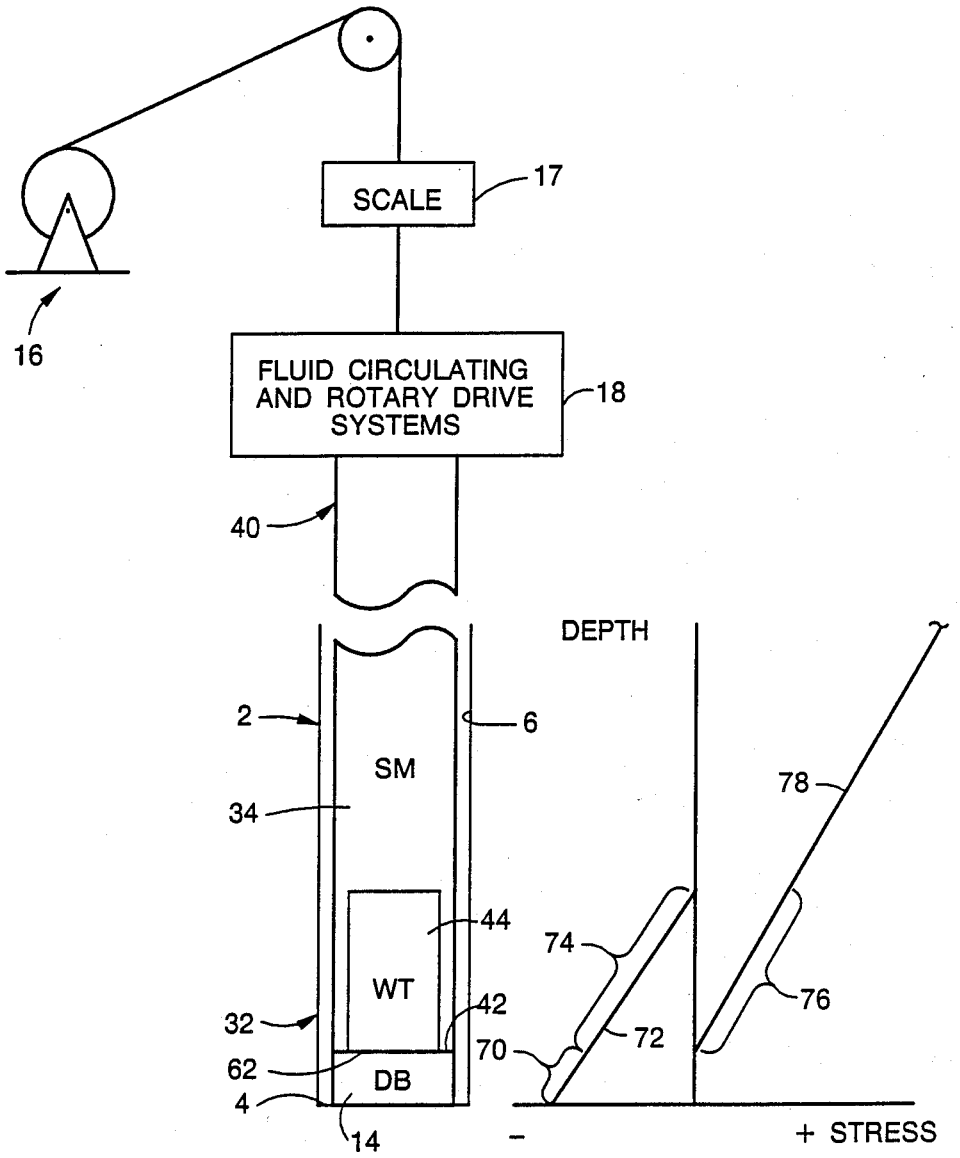
FIG. 2 is a schematic diagram of a drilling assembly incorporating the present invention, a portion of which is shown in association with a stress diagram.
Figure 3:
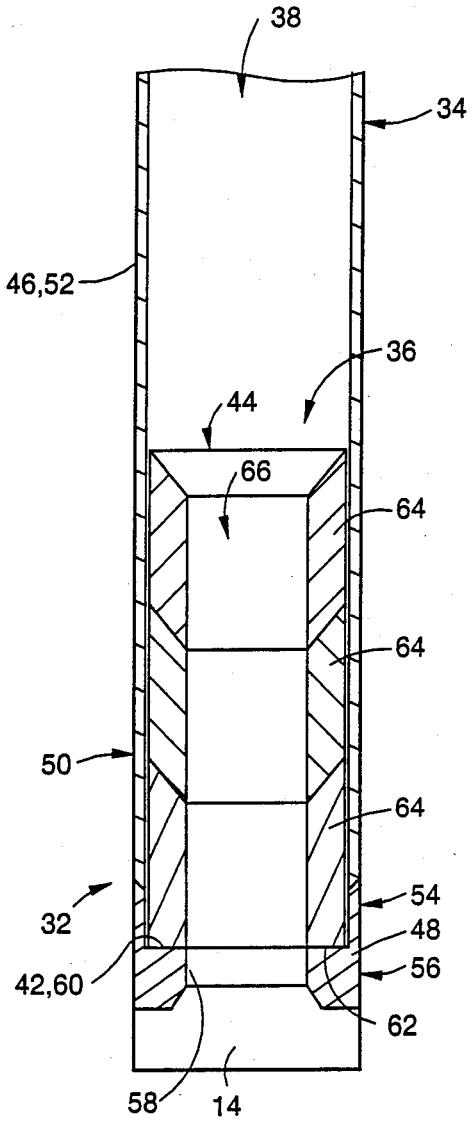
FIG. 3 is a schematic sectional illustration of one embodiment of a drilling apparatus, including a stabilizer apparatus, of the present invention.
Figure 4:
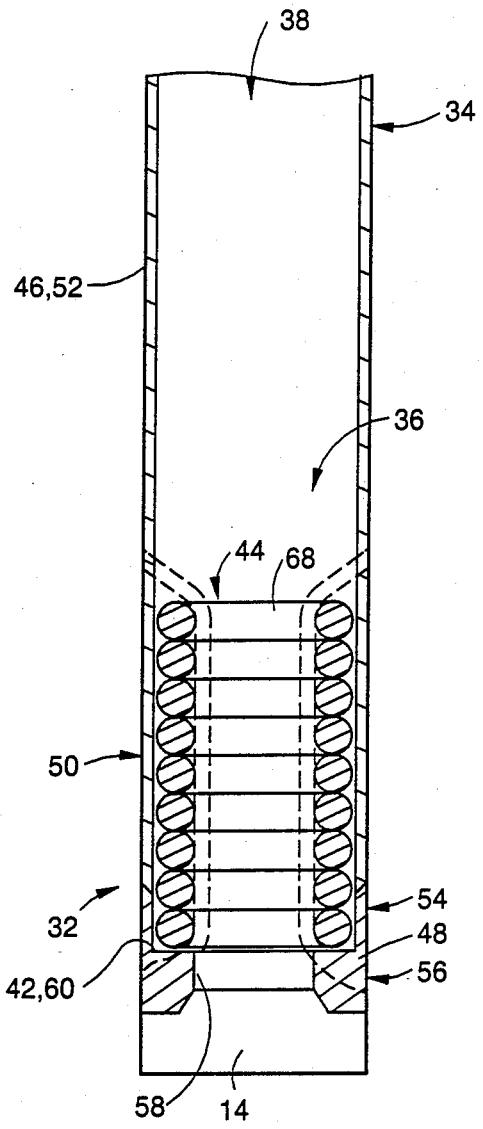
FIG. 4 is a schematic sectional diagram of another embodiment of a drilling apparatus, including a stabilizer apparatus, of the present invention.

Referring next to FIGS. 2–4, the preferred embodiments of the present invention will be described. The present invention can be utilized in the same environment as that illustrated in FIG. 1. That is, it can be used to drill the same type of borehole 2 having a bottom surface 4 and a side surface 6 and it can be used with the same type of surface equipment as denoted in FIG. 2 by the use of the same reference numerals as are used in FIG. 1. It is in the downhole equipment where the drilling apparatus and stabilizer apparatus of the present invention are embodied.

Broadly, the drilling apparatus of the present invention includes a drill bit, support means for carrying the drill bit, and weight means for providing a weight for loading on the drill bit, which weight means is separate from, but carried within, the support means. In the preferred embodiments the stabilizer apparatus is a part of the drilling apparatus as will be further explained hereinbelow.

The drill bit of the preferred embodiment can be the same as the drill bit used in the conventional drilling apparatus shown in FIG. 1, which similarity is denoted by the use of the same reference numeral in FIG. 2. It is to be noted that "drill bit" is defined herein to mean any end implement such as a conventional bit (e.g., roller cone bit) or a core bit or any other implement for penetrating into the substance to be drilled. The drill bit 14 is connected at a lower end 32 of the support means which is labeled "SM" and marked with the reference numeral 34 in FIG. 2.

As more clearly shown in FIGS. 3 and 4, the support means 34 has defined in its lower end 32 a cavity 36. The cavity 36 is part of a hollow interior region 38 extending longitudinally through the entire length of the support means 34 from the lower end 32 upwards to an upper end 40 (FIG. 2). At the bottom of the cavity 36 there is defined an annular shoulder 42 on which the weight means, generally identified by WT and the reference numeral 44, is supported.

In the illustrated preferred embodiments the shoulder 42 is substantially the only part of the support means 34 in compression. The remainder of the support means 34 is in tension for providing stabilization as will be more fully explained hereinbelow. This partial compression, partial tension loading of the support means 34 is controlled in the conventional manner by the hoist means 16 which is connected, along with the scale 17 and the fluid circulating and rotary drive systems 18, to the upper end 40 of the support means 34. The shoulder 42 is placed in compression for transferring the weight provided by the weight means 44 to the drill bit 14.

As more particularly identified in FIGS. 3 and 4, the support means 34 includes a drill string 46 and a load transfer member 48, connected to a lower end 50 of the drill string 46 and also connected to the drill bit 14. The member 48 defines the shoulder 42 and provides the means for transferring the weight load of the weight means 44 to the drill bit 14.

The drill string 46 includes the aforementioned hollow interior region 38 and upper end 40 of the support means 34. The drill string 46 also includes its own lower end 50 which defines part of the lower end 32 of the support means 34 (the load transfer member 48 is another part included within the lower end 32 of the support means 34). The drill string 46 is also the portion of the support means 34 which is preferably always maintained in tension or at least substantially so with only a very short length at the lower end 50 adjacent the load transfer member 48 possibly being in compression usually resulting only from an imprecision in controlling the compression/tension loading with the hoist means 16. Any such length of the drill string 46 in compression should at best be only a very small portion of the section of the drill string adjacent the internally carried weight means 44.

The drill string 46 is made up of outer tubular members 52 which may be referred to as outer drive rods. In the preferred embodiments these are identical or slightly modified (optimized for size) versions of existing equipment, such as conventional drill pipe. As in a conventional drill string, these members are used to transmit torque and provide hydraulic sealing so that conventional oilfield threaded connections are used (no connections, or joints, shown; but would be present as would be readily understood). These tubular members 52 which are conventionally connected in end-to-end fashion extend to the surface where the upper end 40 thereof is connected to the surface equipment in conventional fashion. As previously stated, in the preferred embodiment these outer drive rod tubular members are maintained in tension (with the previously noted exception, which exception as to placing part of the drill string 46 in compression can be extended to a significant length, even all, of the drill string 46 if desired for adding further loading onto the drill bit 14 or otherwise; however, the stabilizing feature of the present invention to be more fully described hereinbelow could be lost).

Connected to the bottom of the lowermost tubular member 52 of the drill string 46 is the load transfer member 48. In the illustrated embodiments this is the lowermost portion of the support means 34 and provides means for connecting with the drill bit 14 and for being placed in compression for transferring to the drill bit 14 the weight provided by the weight means 44 while the remainder of the support means is in tension.

In the preferred embodiment the load transfer member 48 is a cylindrical body having an upper end 54 connected, such as in a conventional threaded connection, to the lower end 50 of the drill string 46. The cylindrical body also includes a lower end 56 configured to couple with the drill bit 14 in a conventional manner. The cylindrical body also includes a longitudinal surface 58 defining an axial or longitudinal fluid passageway for communicating to the drill bit 14 drilling fluid pumped down the hollow interior region 38 of the drill string 46 for uses as known in the art. Extending radially outwardly from the top of the longitudinal, cylindrical surface 58 is an interior upwardly facing annular surface 60 defining the weight means-contacting surface of the shoulder 42. As so embodied, the load transfer member 48 is a rigid member which communicates the weight loading from the weight means 44 to the drill bit 14 by being placed in compression.

It is contemplated that other types of load transfer means could be used. For example, a slip joint, although more mechanically complex than a rigid body and thus more susceptible to malfunctions, could be used. Additionally, the load transfer means could be defined integrally with the lowermost tubular member of the drill string 46 by integrally forming an integral shoulder and bit coupling means thereon. In general, the present invention encompasses any suitable means for transferring the weight of the weight means 44 to the drill bit 14 while maintaining the advantages obtained with the present invention.

Supported by and free-standing above the shoulder 42 is the weight means 44. Although the weight means 44 is free-standing, it is constrained against lateral movement (or at least "substantial" lateral movement, particularly "whipping," allowing for any tolerances between the outer periphery of the weight means 44 and the inner periphery of the drill string 46) by the support means 34 along the entire length of the weight means 44. In the preferred embodiments the weight means 44 is disposed within at least a portion of the part of the support means 34 which is in tension (i.e., within one or more of the tubular members 52).

In the illustrated embodiments the weight means 44 is a mass or body which is always in compression. As generally designated in FIG. 2, it has a bottom surface 62 disposed adjacent the interior upwardly facing surface 60 of the shoulder 42 defined by the load transfer member 48. The weight means 44 will typically have a considerable length comparable to the length of a string of drill collars which would be used to impose the same amount of weight in the conventional drilling apparatus shown in FIG. 1. A seal member may be utilized at or near the top of the weight means to prevent drilled cuttings or other debris from settling and blocking the area between the weight and means and drive rods.

In the preferred embodiments the weight means 44 comprises one or more objects which will be referred to as weight rods. One embodiment of weight rods is shown in FIG. 3. In this embodiment each weight rod is an inner rigid tubular member 64 disposed concentrically within one or more outer tubular members 52, depending upon their relative lengths. Each tubular weight rod member 64 is shown in FIG. 3 as a hollow cylindrical member. Each is stacked on top of another with the lowermost member 64 being supported on the load transfer member 48. This provides vertical support to the cylindrical column of members 64, and the adjacent outer, drive rod tubular member or members 52 provide lateral support. This stack or column of tubular members 64 has a longitudinal flow passageway 66 defined axially therethrough to permit drilling fluid flow from the hollow interior region 38 of the drill string 46 to the fluid passageway defined in the load transfer member 48. Fluid circulation passes from the surface, through the bore of the drive rods 52, then both through the bore of the weight rod members 64 and the annular space formed between the members 64 and the surrounding drive rods 52. The diameter of the passageway 66 can be selected to prevent or reduce a comparable pressure increase which has been noted to occur with relatively narrow inner diameter drill collars. This inner diameter is also sufficient to permit the use of conventional core retriever and retrieval equipment when the present invention is particularly adapted for use in high-speed coring techniques.

The weight rod members 64 of the FIG. 3 embodiment are preferably composed of steel or any other suitable material chosen for its density and mechanical properties particularly suited for its end use within the present invention. The weight rod members 64 do not necessarily extend entirely to the surface; rather, only enough members 64 are inserted in the lower portion of the drill string 46 to provide the maximum desired axial load (weight-on-bit) to the drill bit 14. That is, the maximum weight-on-bit is preferably provided entirely by the buoyed weight of the weight rods 64.

The weight rod members 64 may be attached together in any suitable fashion. The connections are not necessarily typical of normal downhole threaded connections because there are no pressure-sealing or torque-transmitting requirements. Threaded connections can be used, but less costly connections, such as simple "J-slot" or beveled (as shown in FIG. 3) joints can be used. Such simplified connections can be readily handled with virtually no additional expenditure of rig time.

An alternative embodiment of weight rods is shown in FIG. 4. This embodiment includes a coiled mass (e.g., solid-diameter rod or hollow tubing) stack 68. In FIG. 4 this stack is shown wrapped in a continuous cylindrical helix within the adjacent tubular member or members 52 of the drill string 46. As with the embodiment shown in FIG. 3, the embodiment shown in FIG. 4 is supported from below by the load transfer member 48 and around its circumference by the adjacent portion of the drill string 46. An advantage of using a coiled stack 68, such as a coiled tubing, is that it provides for ease of handling and eliminates the need for multiple connections as needed with the individual weight rod members 64.

The above-described preferred embodiments of the drilling apparatus of the present invention include the stabilizer apparatus of the invention. The stabilizer apparatus includes the weight means 44. It also broadly includes confining means, connected with the drill string 46, for confining the weight means 44 against lateral displacement in response to tension in the confining means. In the illustrated preferred embodiments, the confining means includes at least one rigid tubular member, specifically in the preferred embodiments at least one of the members 52 making up, and connected in line with, the drill string 46. Further, the stabalizer element can be inside of the weight rod members 64, i.e., the drillstring 46 narrows and the members 64 are disposed around same.

This stabilizer apparatus provides a particular apparatus which is useful in implementing the methodology of the present invention for stabilizing a rotating drill string and drill bit (i.e., for the illustrated embodiments, the drill string 46 and the drill bit 14 rotated by the rotary drive of the systems 18). This methodology broadly comprises exerting weight on the drill bit with a mass separate from the drill string, and confining the mass against substantial lateral deviation within at least one member retained under tension.

This is performed in the illustrated embodiment by supporting within the cavity 36 of the drill string 46 the weight means 44 for providing a weight exerted on the drill bit 14 rotated by the rotating drill string 46. It is also performed by supporting the rotating drill string 46 so that at least the portion of the drill string 46 adjacent the weight means 44 is in tension. This latter step of supporting the rotating drill string is done in the preferred embodiment utilizing the hoist means 16. The hoist means 16 is controlled to place the lowermost part of the support means 34, specifically the load transfer member 48, in compression to transfer the weight of the weight means 44 (and also the weight of the load transfer member 48) to the drill bit 14. The hoist means 16 is also controlled to concurrently maintain the remainder of the support means 34, specifically the drill string 46, in tension. This utilization of the hoist means 16 can be done in a known manner with the compression/tension loading being determined using the scale 17 to which the drill string 46 is connected.

Although the loading in the support means 34 is controllable via the hoist means 16, in the preferred embodiment the weight means 44 is always in compression because it is not tethered to anything. If it is desired to control the loading of the weight means 44, this could be done by hanging the weight means 44 in a manner similar to how the support means 34 is hung, but separately therefrom so that the loading of the support means 34 and the loading of the weight means 44 would be independently controllable.

Referring to the overall drilling apparatus provided by the present invention, it can be used to perform the method of drilling also provided by the present invention. The overall drilling method includes the step of rotating the drill string and drill bit assembly. This is done in a conventional manner as previously described.

The drilling method also includes carrying inside the drill string 46 a mass which is separate from the drill string 46. This is done in the illustrated embodiments by supporting the weight means 44 on the load transfer member 48 inside one or more of the outer tubular members 52. Because the weight means 44 of the preferred embodiment is free-standing, it is maintained in compression throughout the drilling operation.

The drilling method further includes transferring to the drill bit 14 a weight exerted by the mass of the weight means 44. This is done in the illustrated embodiments by controlling the hoist means 16 to place at least the load transfer member 48 in compression so that the compression load of the weight means 44 is imposed on the drill bit 14. Thus, instead of a considerable length of the lowermost portion of the string where drill collars would normally be located being operated in compression, preferably only the short load transfer member 48 is placed in compression. The drill string 46 extending above the load transfer member 48 is at all times, in the preferred embodiment, maintained in tension because the maximum desired weight-on-bit is, by design, less than the buoyed weight of the weight means 44.

As just stated, the drilling method of the preferred embodiment of the present invention also comprises retaining the drill string 46 in tension, specifically for providing drill string stability as the drill string and drill bit are rotated. This confines the the weight means 44 against substantial lateral movement within the drill string 46 for preventing buckling of the weight means 44 and the drill string 46 within the borehole 2 formed by the rotating drill string and drill bit so that deviation of the borehole 2 is reduced or prevented. Thus, while the hoist means 16 is controlled to place the load transfer member 48 in compression, it is so controlled so that preferably only the load transfer member 48 is placed in compression while, concurrently with performing the aforementioned steps, maintaining the drill string 46 in tension.

Despite the presence of the weight means 44 and the load transfer member 48 in and at the lower portion of the drill string 46, the present invention does not significantly alter the overall drilling operation itself. For example, weight-on-bit is obtained by conventional operation of the hoist means 16 and use of the scale 17. This is an important advantage in practice because established drilling practices do not have to be changed. The present invention, however, does introduce significant downhole effects to the drilling operation in accordance with the following.

The drill string 46 and the weight means 44 are preferably sized so that all of the necessary bit weight is provided by the weight means 44 (and, negligibly, the load transfer member 48). The weight means 44 is in compression at all times, thereby subjecting it to buckling forces similar to those present in conventional drill strings. The compressive loading on the drill bit 14 and load transfer member 48 resulting from loading by the weight means 44 is shown by segment 70 of compression-indicating graph line 72 in the stress diagram of FIG. 2. The compression of the weight means 44 is indicated by the graph line segment 74. Assuming comparable weights and cross-sectional areas, the graph line 72 would be identical to the graph line 20 shown in FIG. 1, thereby indicating that identical weight-on-bit loading is obtainable with the present invention.

The buckling which can result from this compression is, however, resisted by the supporting force which the drill string 46 provides by being in tension. This tensile supporting force resists the "whipping" which has been found to occur in conventional drilling operations. This supporting force is indicated in the stress diagram of FIG. 2 by the segment 76 of the tension-indicating graph line 78. The graph line 78 represents tension of that length of the support means 34 above the minute portion which is in compression to transfer the load of the weight means 44 to the drill bit 14 (i.e., the drill string 46 versus the load transfer member 48 for the illustrated preferred embodiments). The segment 76, itself, correlates to that portion of the support means 34 which is adjacent the entire length of the weight means 44. From the stress diagram shown in FIG. 2 it is readily apparent that this retaining tension of the segment 76 overlaps the compression segment 74, thus representing the support provided by the portion of the drill string 46 overlying the weight means 44. It is this overlapping retaining force which provides the stabilization obtained by the present invention.

Figure 5:
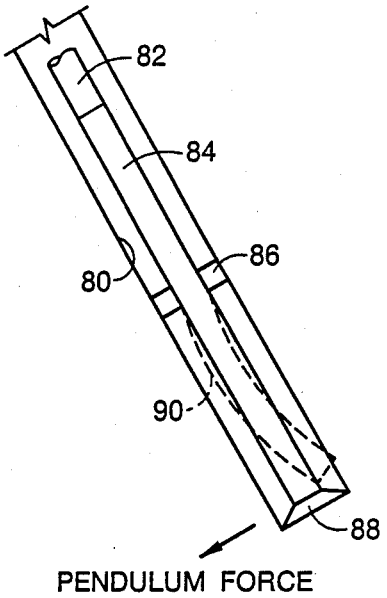
FIG. 5 PRIOR ART
FIG. 5 is a schematic illustration of a conventional prior art bottom hole assembly with pendulum stabilizer.
Figure 6:
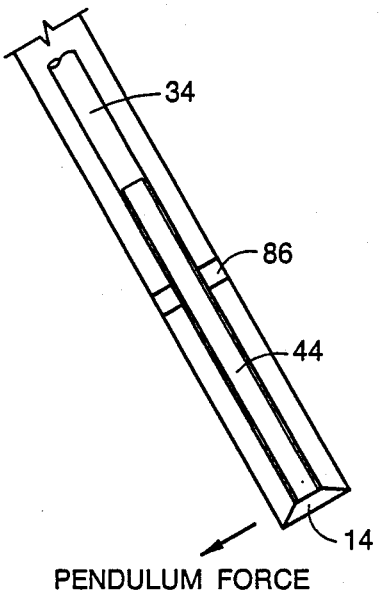
FIG. 6 is a schematic illustration of the present invention in association with a pendulum stabilizer.

A particular operating advantage of this stabilization obtained by the present invention will be described with reference to FIGS. 5 and 6 which pertain to directional drilling. FIG. 5 illustrates a prior art configuration wherein a borehole 80 is being drilled by a conventional drilling apparatus including a drill string 82 in tension, below which extends a string of drill collars 84 in compression. For attempting to maintain deviation control during the directional drilling, a conventional pendulum stabilizer 86 is used at a selected location along the string of drill collars 84. A drill bit 88 is located at the bottom of the string of drill collars 84.

In the bottomhole assembly comprising the string of drill collars 84, the pendulum stabilizer 86 and the drill bit 88, the compression therein tends to cause buckling as indicated by dashed lines identified by the reference numeral 90. This results in dynamic forces which cause the net force applied at the drill bit 88 to deviate from the ideal pendulum tendency. Bit tilt which results from the buckling can reduce the dropping tendency of the bottomhole assembly.

When the present invention is used, however, the weight means therein is in compression, but it is stabilized by the outer support means which remains substantially in tension. The buckling tendency of the bottomhole assembly is thus reduced. This allows the performance of the pendulum assembly to approach the ideal situation by mitigating the detrimental effects of the bottomhole assembly buckling illustrated in FIG. 5. The components illustrated in FIG. 6 include the support means 34, the weight means 44, the drill bit 14 and the pendulum stabilizer 86. Thus, since the buckling tendency of the weight means 44 is resisted by the support means 34, there are less dynamic forces at the drill bit and lower bit tilt.

While presently preferred embodiments of the invention have been described herein for the purpose of disclosure, numerous changes in the construction and arrangement of parts and the performance of steps will suggest themselves to those skilled in the art, which changes are encompassed within the spirit of this invention as defined by the appended claims.

What is claimed is:

1. A drill collar assembly adapted to form part of a drill string used in drilling a borehole in the earth, comprising:

one or more elongated outer tubular members having connection means at both ends each thereof for interconnection one to another, a lower-most tubular member interconnectable with a drill bit and the lower-most turbular member including an interior weight transfer shoulder; and one or more free-standing weighting members disposed within the tubular members, a lower-most weighting member being adapted to rest upon the interior shoulder of the lower-most tubular member.

2. A drill collar assembly of claim 1 wherein the one or more weighting members comprises at least one weight rod.

3. A drill collar assembly of claim 2 wherein the one or more weighting rods include means to interconnect one weight rod to another.

4. A drill collar assembly of claim 1 wherein the one or more weighting members comprises a coiled weight mass.

* * * * *